US010973275B2

(12) United States Patent
Ulmer et al.

(10) Patent No.: US 10,973,275 B2
(45) Date of Patent: Apr. 13, 2021

(54) PERSONAL PROTECTION SYSTEM WITH A COOLING STRIP THAT IS BOTH REMOVABLE AND THAT IS COMPLIANT RELATIVE TO THE SKIN

(71) Applicant: Stryker Corporation, Kalamazoo, MI (US)

(72) Inventors: Bryan Matthew Ulmer, Grand Rapids, MI (US); Brian VanDerWoude, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 309 days.

(21) Appl. No.: 15/761,363

(22) PCT Filed: Sep. 19, 2016

(86) PCT No.: PCT/US2016/052491
§ 371 (c)(1),
(2) Date: Mar. 19, 2018

(87) PCT Pub. No.: WO2017/053232
PCT Pub. Date: Mar. 30, 2017

(65) Prior Publication Data

US 2018/0263326 A1 Sep. 20, 2018

Related U.S. Application Data

(60) Provisional application No. 62/221,266, filed on Sep. 21, 2015.

(51) Int. Cl.

| | |
|---|---|
| ***A42B 3/28*** | (2006.01) |
| ***A41D 13/005*** | (2006.01) |
| *F25B 21/02* | (2006.01) |

(52) U.S. Cl.
CPC ..... *A42B 3/285* (2013.01); *A41D 13/0053* (2013.01); *F25B 21/02* (2013.01); *F25B 2321/0212* (2013.01)

(58) Field of Classification Search
CPC ..... A43B 3/28; A43B 3/285; A41D 13/0053; F25B 21/02; F25B 2321/0212
See application file for complete search history.

(56) References Cited

U.S. PATENT DOCUMENTS 4,470,263 A 9/1984 Lehovec et al.
4,483,021 A 11/1984 McCall
(Continued)

FOREIGN PATENT DOCUMENTS

JP H09209210 A 8/1997
JP 2004270087 A 9/2004
(Continued)

OTHER PUBLICATIONS

Invitation to Pay Additional Fees/Partial International Search Report for PCT/US2016/052491 dated Dec. 12, 2016, 7 pages.
(Continued)

*Primary Examiner* — Richale L Quinn
(74) *Attorney, Agent, or Firm* — Howard & Howard Attorneys PLLC

(57) ABSTRACT

A personal protection system that includes a headband (52) to which a face shield (38) is mounted. A cooling strip (120) is mounted to the headband. The cooling strip includes at least one thermoelectric cooling module (150). A draw strip (128) formed from a flexible thermally conductive material is also part of the cooling strip. The draw strip is bonded to the heat absorbing surface (152) of the thermoelectric cooling module and extends outwardly from the module. A biasing assembly (134, 186) urges the portions of the draw strip spaced from the thermoelectric cooling module against
(Continued)

the skin of the individual wearing the personal protection system.

13 Claims, 10 Drawing Sheets

(56) References Cited

U.S. PATENT DOCUMENTS

| | | | | |
|---|---|---|---|---|
| 5,655,374 | A | 8/1997 | Santilli et al. | |
| 6,401,461 | B1 | 6/2002 | Harrison et al. | |
| 6,438,964 | B1 * | 8/2002 | Giblin | A41D 13/005 62/259.3 |
| 6,481,019 | B2 | 11/2002 | Diaz et al. | |
| 6,990,691 | B2 * | 1/2006 | Klotz | A41D 13/1153 2/171.3 |
| 7,296,304 | B2 | 11/2007 | Goldsborough | |
| 7,735,156 | B2 | 6/2010 | VanDerWoude et al. | |
| 7,802,318 | B2 * | 9/2010 | Chen | A42B 3/286 2/171.3 |
| 7,937,775 | B2 * | 5/2011 | Manzella, Jr. | A41D 13/0025 2/171.3 |
| 8,087,254 | B2 | 1/2012 | Arnold | |
| 8,302,599 | B2 | 11/2012 | Green | |
| 8,336,113 | B2 | 12/2012 | Uttrachi | |
| 8,584,265 | B2 | 11/2013 | Lilenthal et al. | |
| 8,667,960 | B2 * | 3/2014 | Ausen | A62B 18/045 128/201.25 |
| 10,687,568 | B2 * | 6/2020 | Pavalarajan | A42B 3/286 |
| 10,709,911 | B2 * | 7/2020 | Pavalarajan | A62B 18/045 |
| 2001/0032348 | A1 * | 10/2001 | Diaz | A41D 13/1153 2/171.3 |
| 2004/0059400 | A1 * | 3/2004 | Lin | A61F 7/007 607/109 |
| 2008/0141681 | A1 * | 6/2008 | Arnold | A42B 3/286 62/3.5 |
| 2010/0005572 | A1 * | 1/2010 | Chaplin | A42B 3/285 2/411 |
| 2011/0078845 | A1 | 4/2011 | McKinney | |

FOREIGN PATENT DOCUMENTS

| | | | |
|---|---|---|---|
| JP | 2007321329 | A | 12/2007 |
| JP | 2009534547 | A | 9/2009 |
| WO | 2013114680 | A1 | 8/2013 |

OTHER PUBLICATIONS

International Search Report for Application No. PCT/US2016/052491 dated Mar. 16, 2017, 3 pages.

Activecool, "Understanding Thermoelectric Cooling", downloaded from http://www.activetool.com/technotes/thermoelectric.html on Aug. 14, 2015, 4 pages.

T-Global Technology, "PH3 Heat Spreader", Aug. 2015, 1 page.

English language abstract and machine-assisted English translation for JPH 09-209210 extracted from espacenet.com database on Sep. 2, 2020, 9 pages.

English language abstract and machine-assisted English translation for JPH 2004-270087 extracted from espacenet.com database on Sep. 2, 2020, 6 pages.

English language abstract for JP 2007-321329 extracted from espacenet.com database on Sep. 2, 2020, 1 page.

English language abstract for JP 2009-534547 extracted from espacenet.com database on Sep. 2, 2020, 1 page.

English language abstract for WO 2013/114680 extracted from espacenet.com database on Sep. 2, 2020, 2 pages.

* cited by examiner

PERSONAL PROTECTION SYSTEM WITH A COOLING STRIP THAT IS BOTH REMOVABLE AND THAT IS COMPLIANT RELATIVE TO THE SKIN

CROSS-REFERENCE TO RELATED APPLICATIONS

The present application is a National Stage of International Patent Application No. PCT/US2016/052491, filed on Sep. 19, 2016, which claims priority to and all the benefits of U.S. Provisional Patent Application No. 62/221,266, filed on Sep. 21, 2015, both of which are hereby expressly incorporated herein by reference in their entirety.

FIELD OF THE INVENTION

This invention generally relates to a personal protection system such as the type of personal protection system worn by a healthcare provider. The personal protection system of this invention includes a cooling strip that draws heat away from the individual wearing the system.

BACKGROUND OF THE INVENTION

During some medical and surgical procedures, a healthcare provider will wear an assembly known as a personal protection system. This type of assembly includes a helmet. A protective garment is placed over the helmet to, at a minimum, cover the head of the wearer. A garment that only extends a short distance below the head is sometimes referred to as a hood. A garment that extends to the waist or even below the waist is referred to as a gown or a toga. Regardless of the length, the garment includes a transparent face shield. The fabric forming the garment provides a barrier between the healthcare provider and the ambient environment. The face shield is a transparent part of this barrier that provides a view of the location at which the procedure is being performed.

The barrier benefits both the patient and the healthcare provider. The barrier substantially eliminates the likelihood that the healthcare provider may come into contact with fluid or solid bits of matter from the patient that may be generated during the course of the procedure. Also, a healthcare provider, like any individual, invariably emits microscopic and near microscopic sized dead skin cells, perspiration droplets and saliva. The barrier provided by the personal protection system substantially eliminates the possibility this material will land on the normally concealed tissue of the patient that is exposed in order to perform the procedure. The limiting of the extent to which the patient's internal tissue is exposed to this material results in a like reduction in the likelihood that the material will induce an infection in tissue.

If an individual simply wears a garment over the head, an inevitable result of that individual's breathing would be the build up of carbon dioxide and water vapor under the garment. No one, especially a healthcare worker performing a procedure, wants to be subjected to the harmful effects of excessive exposure to carbon dioxide. If water vapor is allowed to build up inside the garment, the vapor could condense against the inside surface of the face shield. The formation of these water droplets can reduce the visibility through the face shield.

To avoid the undesirable results of carbon dioxide and water vapor from building up under the garment of a personal protection system, a fan is mounted to the helmet of the personal protection system. The fan draws air into the space under the garment, the space around the head of the person wearing the system. This air forces the carbon dioxide and water vapor laden air away from around the head of the individual wearing the system. Examples of such systems are described in U.S. Pat. No. 6,481,019/PCT Pub. No. WO 2001/052675 and U.S. Pat. No. 7,735,156/PCT Pub. No. WO 2007/011646 each of which is incorporated herein by reference. Present personal protection systems both provide a barrier around an individual wearing the system and prevent the undesirable build of carbon dioxide and water vapor under the garment.

Nevertheless, an individual wearing a personal protection system, like any individual, generates heat. This heat warms the air immediately adjacent the individual. When an individual is not wearing a personal protection system, the heat in the air immediately adjacent the individual is transported away from the individual by the convective movement of the air away from the individual as well as by the conduction of the heat into the air parcels spaced away from the individual. When an individual wears a personal protection system, the garment restricts the flow of air away from the individual. While the fan circulates air through the garment, the resultant convective and conductive transport of the heat away from the air surrounding the individual is less than what occurs when the garment is not worn.

Consequently, when some individuals wear a personal protection system, the air around these individuals can become uncomfortably warm. Surgeons, in particular, are known to consider being encased in a personal protection garment a less than desirable experience. This is because a surgeon, in response to feeling stress during a procedure, may generate more heat than an individual who does not have the surgeon's responsibility. The generation of this relatively large quantity of heat can result in the environment inside the personal protection garment becoming unpleasant.

In theory, it is possible to reduce the build up of warm air inside a personal protection garment by increasing the rate of flow of air through the garment. This would require providing the system with a fan capable of producing this type of air flow. One disadvantage of this type of system is that a providing the system with a large fan typically results in providing the system with a fan that emits an appreciable amount of noise. The added noise pollution this type of fan can contribute to an operating room inherently makes it more difficult for the individuals wearing the personal protection system to communicate. Further, this added noise pollution adds to the distractions the individuals performing the procedure have to ignore to concentrate on the procedure. Another disadvantage of providing a personal protection system with a fan with larger air flow capabilities than fans currently used is that this fan draws more power than the power drawn by the current fans. Typically, the power is provided to personal protection system fan by a battery. If the power draw of the fan is increased there is an increased likelihood that, during the procedure, system battery will be completely drained. If the individual wearing the system wants to continue to use the system, this would require interrupting the procedure in order to replace the battery.

Another solution has been proposed regarding how to keep an individual wearing a personal protection system cool. This solution involves placing Peltier modules inside the helmet of a personal protection system. A Peltier module, sometimes referred to as a thermoelectric cooling module, is a laminate structure that has a ceramic superstrate and an opposed ceramic substrate. Sandwiched between the superstrate and substrate are semiconducting components. Conductors flow the electricity through the semiconducting components. The current flow through the semiconducting components fosters the transport of thermal energy between opposed surfaces of the module. One surface becomes a heat sink. The opposed surface becomes a heat source. An inherent feature of a surface that functions as a heat source is that the surface draws heat, thermal energy, away from what surrounds the surface. Thus, the surface of a Peltier module that is the heat source functions as cooling plate since that surface draws heat away from an object in contact with the surface.

It has therefore been proposed that one or more Peltier modules could be mounted inside the helmet of a personal protection system. The modules would be mounted to the helmet so the heat source surfaces of the modules press against the skin of the individual wearing the system. When the system is activated, current is flowed through the Peltier modules. The Peltier modules would draw heat away from the skin against which the modules abut. The drawing away of this heat would help keep the temperature of the individual wearing the system within a desirable range.

There are, however, disadvantages of simply providing the helmet of personal protection system with one or more skin abutting Peltier modules. One disadvantage of this type assembly is that when a Peltier module is activated, the heat source surface draws thermal energy away from the surface of the object immediately in contact with the module. This means that when a module is simply in contact with the skin, most of the heat loss is from the skin immediately in contact with the module. As a result, the individual wearing the helmet can feel as if only localized portions of his/her body are being kept cool. This feeling is analogues to what a person feels when the skin is cooled by placing ice cubes at spaced apart locations on the skin. The difference in skin temperature between where the cooling is occurring and adjacent section where the cooling is not occurring can be substantial. This difference can be disconcerting to the person wearing the personal protection system.

Further when the application of current to a Peltier module is terminated there may be a significant amount of thermal energy adjacent the module. For example, this thermal energy may be stored in a heat sink adjacent the surface of the module spaced from the individual against which this module is pressed. As a result of the deactivation of the Peltier module, this thermal energy can flow back to the surface of the module pressed against the individual. This thermal energy can flow into the skin the person against which the Peltier module is pressed. When this event occurs, the individual wearing this cooling unit, instead of being cooled by the Peltier modules, is heated.

Further some individuals that use a personal protection system may not want the system to include Peltier modules. For example, during a procedure an individual participating in the procedure, owing to his/her personal physiology, may not need the added cooling the Peltier modules can provide under the garment. This individual may even be irritated by having to wear a helmet that includes the added weight of the Peltier modules. In theory, a surgical facility could resolve this problem by providing some helmets with Peltier modules and other helmets without these modules. However, unless a relatively large number of both types of helmets are provided, it may be difficult to, for a procedure, have enough of both types of helmets to ensure that preferences of each individual participating in the procedure is met.

SUMMARY OF THE INVENTION

This invention is related to a new and useful personal protection system such as the type of system used to provide a sterile barrier between medical personal and a patient. The personal protection system of this invention is designed for use by both individuals that would enjoy having heat removed by the Peltier modules and individuals that would prefer not having to wear a system that includes these modules. For the individual that would enjoy the added cooling providing by the Peltier modules the invention is constructed to ensure that the draw of heat away from the individual is over an area wider than the surface of the modules. For the individual that does not need to have to wear a helmet with these modules, this invention provides a simple means to easily remove the modules from the garment support structure to which the modules are attached. In many versions of the invention, this garment support is a helmet.

The personal protection system of this invention includes a component that is worn around the head of the individual using the system. In many versions of this invention, this component is a helmet that is worn on the head. The helmet supports a garment that, at a minimum, extends over the head of the individual. The helmet typically, but not always, includes a fan for drawing air from the ambient environment into the garment so the air flows around the head of the individual.

The personal protection system of this invention includes one or more cooling strips. Each cooling strip includes at least one Peltier module. Mounted to the Peltier module is a heat sink. The heat sink performs two functions. The heat sink functions as a thermally conductive member with a larger surface area over which the heat drawn into the Peltier module is conductively diffused into the surrounding environment. A second function of the heat sink is to releasably secure the cooling module to the helmet to which the cooling strip is mounted.

In many preferred versions of the invention, the cooling strip includes plural Peltier modules. In these versions of the invention, the cooling module is typically designed so that the Peltier modules are spaced apart from each other. The cooling strip is further constructed so that the surfaces of the Peltier modules that are the heat absorbing (cooling) surfaces are attached to a common draw strip. The draw strip is formed from thermally conductive material. The opposed surfaces, the heat discharging surfaces, of the Peltier modules are disposed against a biasing element. These biasing elements place a force on the Peltier modules that push the draw strip against the skin of the individual wearing the personal protection system. In some versions of the invention, a single foam strip functions as the set of these biasing elements.

A further feature of this invention is that control unit that regulates the actuation of the at least one Peltier module does not, when the cooling strip is to be turned off, simply completely negate the application of current to the module. Instead after the cooling strip is deactivated, the control unit, cyclically applies current to the at least one module. The current is applied until the at least one module reaches a temperature at which the backflow of any heat will not result in a rise in module temperature that could possible result in the discomforting heating of the individual wearing the cooling strip.

BRIEF DESCRIPTION OF THE DRAWINGS

The invention is pointed out with particularity in the claims. The above and further features and benefits of this invention may be understood by the following Detailed Description taken in conjunction with the accompanying drawing in which:

FIG. 10 is a perspective view of a heat sink; and

DETAILED DESCRIPTION

Figure 1:
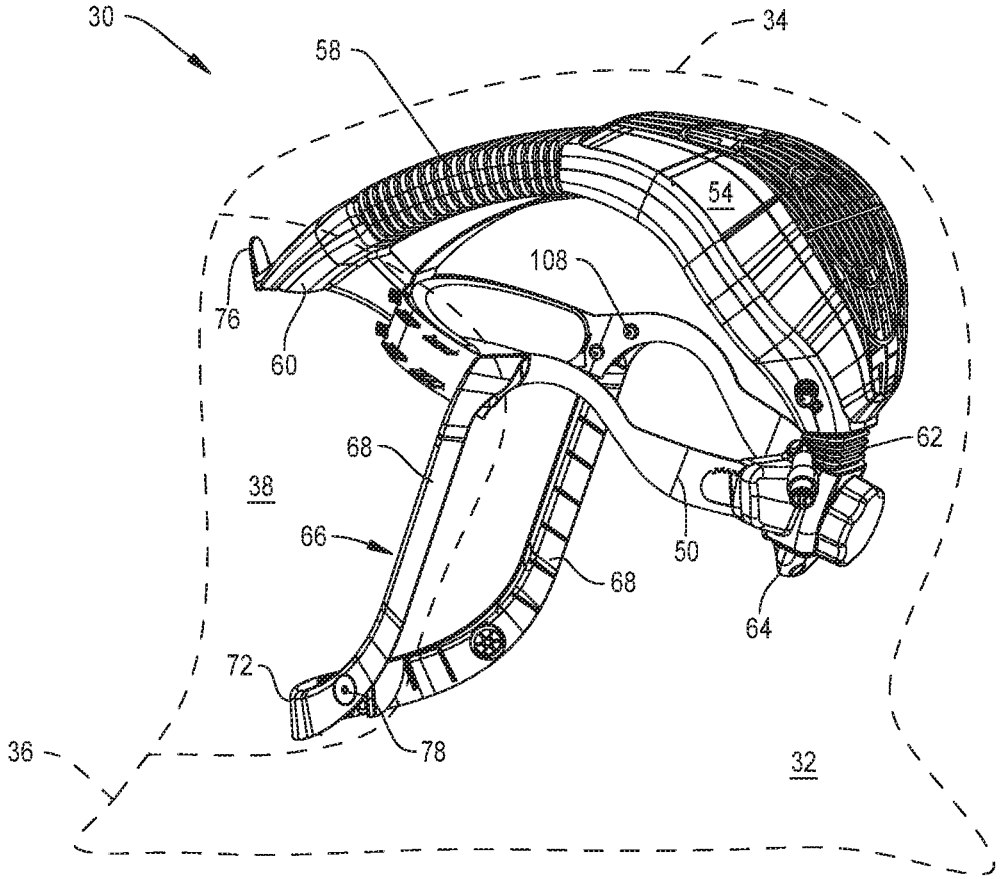
FIG. 1 is a perspective view of a personal protection system constructed in accordance with this invention.

A personal protection system 30 constructed in accordance with this invention, as seen in FIG. 1, includes a garment 32, shown in dashed lines, that is disposed over a helmet 50. The garment 32 is formed from material that forms a sterile barrier between the individual wearing the system 30 and the outside environment. Garment 32 is shaped to have a hood section 34 shaped to extend over the complementary helmet 50. The garment 32 typically includes at least a shoulder section 36 that is integral with and extends below the hood section 34. As implied by its name, the shoulder section extends around the shoulder of the individual. If the garment does not extend below the shoulder, the garment is typically referred to as a hood. Some garments extend below the shoulder. These garments typically have sleeves for receiving the arms of the individual. This type of garment is sometimes referred to as a toga.

The garment hood section 34 is formed with an opening, (opening not identified). A transparent face shield 38 is mounted to the garment to extend over the hood section opening. The face shield 38 is the portion of the garment through which the wearer is able to view the surrounding environment.

Figure 2:
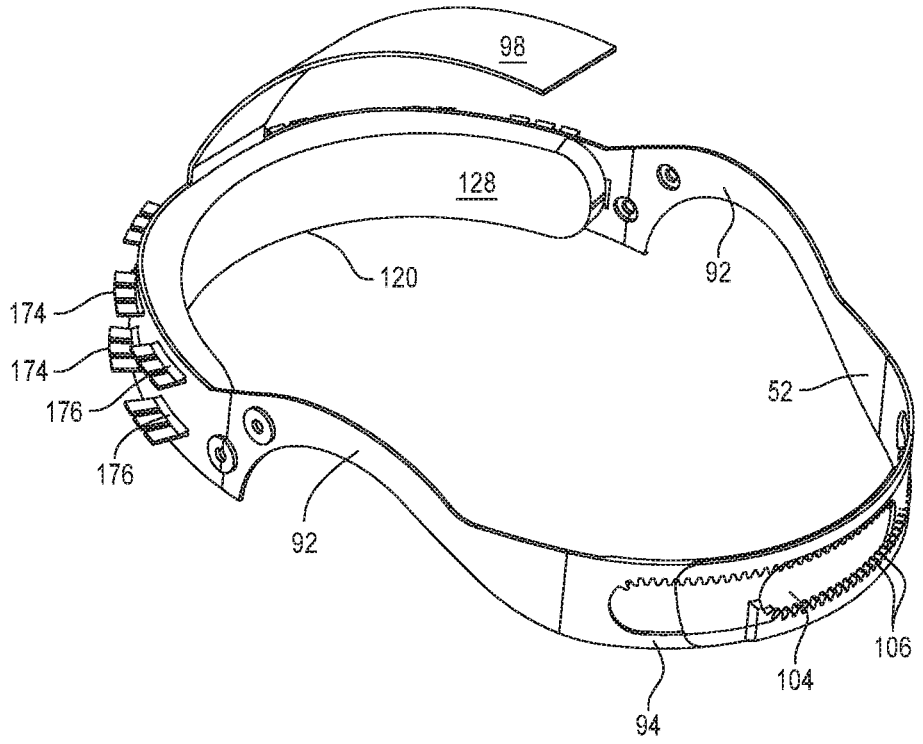
FIG. 2 is a perspective view of the headband of the helmet of this invention with a cooling strip attached.
Figure 3:
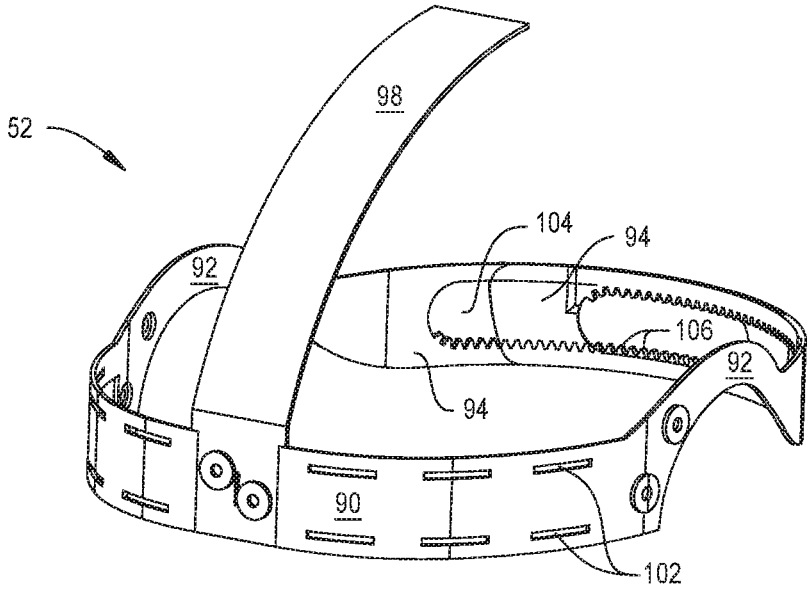
FIG. 3 is a is perspective view of the headband without the cooling strip attached.

Helmet 50, seen in FIGS. 1 and 2, and 3, includes a headband 52. A fan module 54 is disposed above the headband 52. The fan module 54 includes a fan, (not illustrated). The fan internal to the fan module 54 draws air through the overlying hood section 34 of the garment 32. A front nozzle 60 is attached to the front of the headband 52. (Here, "front" and "forward" are understood to mean in a direction directed outwardly from the face of individually wearing system 30. "Back" and "rear" are understood to mean in a directed opposite the front direction.) A rear nozzle 64 is mounted to the back of the headband. Front bellows 58 connects the fan module 54 to the front nozzle 60. Rear bellows 62 connects the fan module to the rear nozzle 64. When the fan module 54 is actuated, a fraction of the air drawn into the module by the fan is forced through the front bellows 58 and discharged out the front nozzle 60. The remaining air drawn into the fan module 54 is forced through the rear bellows 62 and discharged from the rear nozzle 64.

A chin bar 66, also part of the helmet 50, extends below the front portion of the head band 52. The front portion of the head band 52 it is understood to be the portion of the head band worn around the forehead of the individual wearing the personal protection system 30. The chin bar 66 includes two spaced apart posts 70. Posts 70 extend downwardly forwardly outwardly from opposed ends of the forehead section of the headband 52. A beam 72 extends between the free ends of posts 70. Helmet 50 is shaped so that between posts 70, beam 72 curves outwardly. One function chin bar 66 has is to prevent the face shield 38 from collapsing inwardly towards the faces of the individual wearing the system. This reduces the feeling of claustrophobia some individuals have when wearing a hood 34 with a face shield 38 around the head. Beam 92 also defines the radius of curvature of the lower portion of the face shield 38.

The system 30 of this invention also includes components for ensuring the garment face shield 38 is centered in front of the face of the individual wearing the system. In the described version of the invention, one of these features is a tab 76 that protrudes upwardly from the front nozzle 60. The helmet 50 is also provided with two magnets 78, one magnet seen in FIG. 1, that also are part of the holding assembly. Each magnet 78 is mounted to a separate one of the posts 70. The magnets 78 are mounted to posts 70 a short distance, approximately 2 cm, above the beam 72.

While not illustrated, garment 32 is provided with complementary features for releasably holding the face shield 38 in the proper position relative to the helmet 50. These features include an opening in the top of a portion of the face shield. This opening is formed in the section of the face shield that is located inside hood section 34. Two magnetic elements are also mounted to the face shield 38. Collectively, the opening is located and the face shield magnetic elements are positioned so that when helmet tab 76 seats in the opening, the face shield can be flexed around the chin bar beam 72 so the face shield magnets can mate with the helmet magnets 78. As a consequence of the helmet tab 76 seating in the face shield opening and the two sets of magnets engaging, the garment 32 is releasably secured to the helmet 50 so the face shield 38 is located in front of the helmet.

Also part of system 30 of this invention is a cooling strip 120, seen in FIG. 2. The cooling strip 120 is attached to the inner surface of the headband 52. When the cooling strip 120 is actuated, the strip draws thermal energy, heat, away from the individual wearing the system 30.

The headband 52, seen best in FIG. 3, is formed from a flexible plastic such as nylon or polypropylene or PEEK plastic. The headband 52 includes a number of different sections. One of these sections is the previously described forehead section 90. Side sections 92 extend from the opposed ends of the forehead section. Each side section 92 is curved in shape. The curves in the side sections 92 facilitate fitting the side sections above the ears of the individual wearing the helmet 50. A tail 94 extends from the free end of each side section 92. In the illustrated version of the invention a strap 98 extends upwardly from the center of the forehead section. Strap 98 supports the fan module 54.

Headband 52 is further formed so there are pairs of through slots 102 in the forehead section 90 (two slots identified). Slots 102 are parallel to the opposed top and bottom edges of the forehead section 90. The top-located slots 102 are collinear. The bottom-located slots 102 are likewise collinear.

Each tail 94 is formed with an oval shaped opening 104 (one opening identified). The headband is formed so the tails 94 have teeth 106 that extend into the openings 104 (two teeth identified). When the helmet 50 is assembly the headband is wrapped around itself so the tails 94 overlap. The rear nozzle 64 is mounted to the tails 94. Components integral with rear nozzle not illustrated and not part of the present invention hold engage the teeth 106 and hold the tails 94 together to define the closed loop of the headband that seats around the head of the individual. These components allow the length of the sections of the tails 94 that overlap to be selectively set. This allows the size of the loop defined by the headband to be adjusted based on the size of the head of the individual wearing the helmet 50.

Not identified are a number of circular openings formed in the headband. These openings are surrounded by raised sections of the headband, raised sections also not identified. These openings receive fasteners 108, one fastener identified in FIG. 1, hold the front nozzle 60 and chin bar 66 to the headband.

Figure 4:
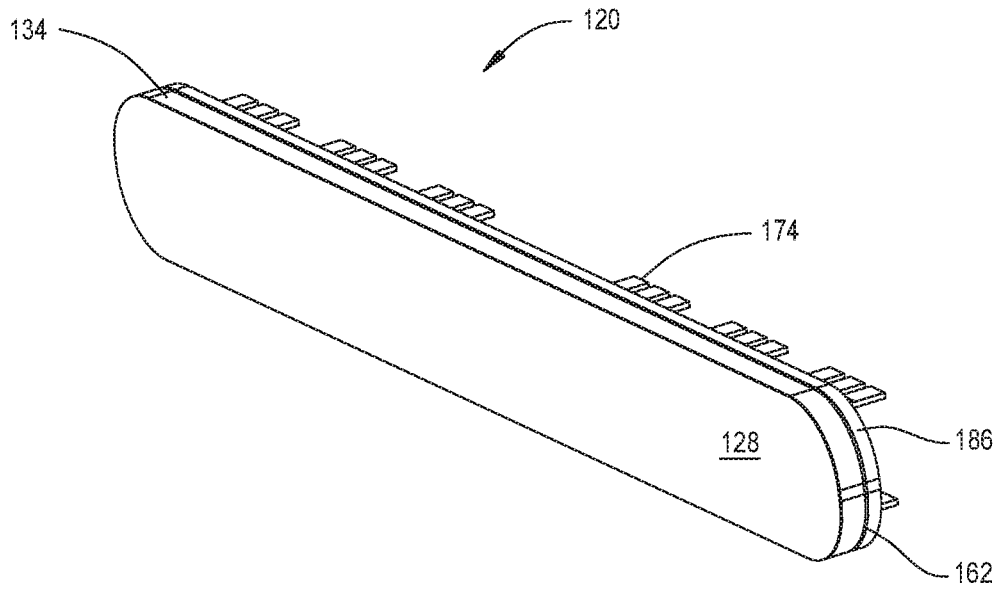
FIG. 4 is a perspective view of the cooling strip wherein the exposed surface of the cooling strip is seen.
Figure 5:
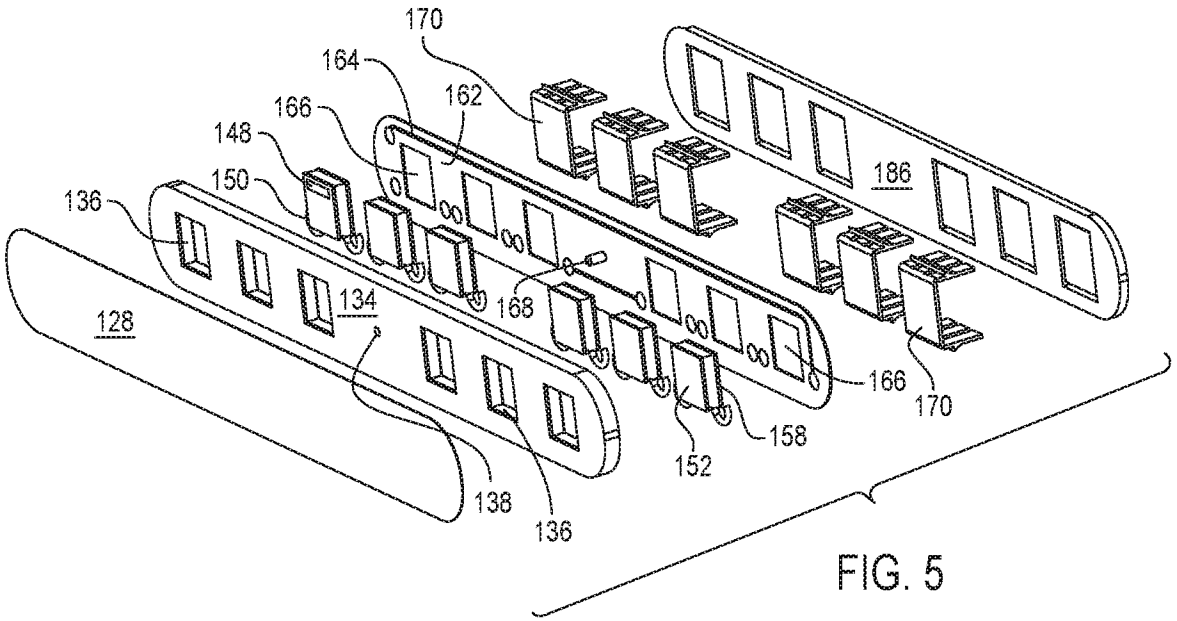
FIG. 5 is a exploded view of the cooling strip.
Figure 6:
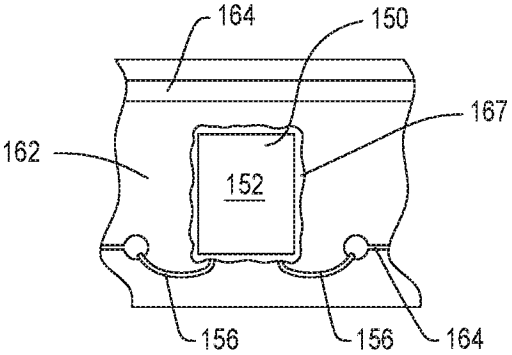
FIG. 6 is a plan view of how a Peltier module is mounted to the flex strip.

The cooling strip 120, now described by reference to FIGS. 4 and 5, includes a number of Peltier modules 150, (one module identified). Sometimes a Peltier module is referred to as a thermoelectric cooling module. Each Peltier module 150 includes on one side a heat absorbing surface 152 (one identified). The opposed side of Peltier module is a heat discharging surface 158, (the edge of one heat discharging surface identified. Not seen are the semiconducting elements internal to the Peltier modules 150. When current is flowed through the semiconducting elements, the charge carriers transfer heat from the component of the module that forms the heat-absorbing surface 152 to the component that forms the heat-discharging surface 158. Two leads 156 extend from each Peltier module 150 as seen in FIG. 6. The leads 156 are the conductors over which current is flowed through the Peltier module 150.

The Peltier modules 150 are mounted to a flex strip 162, also part of the cooling strip 120. Flex strip 162 is formed from a flexible material such as copper or polyimide. Conductors 164, one identified in FIG. 5, are formed on or embedded in the flex strip 162. Conductors 164 are the conductive components of the cooling strip 120 over which current is sourced through leads 156 to the Peltier modules 150.

The flex strip 162 is formed with plural spaced apart windows 166, two windows identified. Each Peltier module 150 is seated in a separate one of the windows 164. As seen in FIG. 6, epoxy 167, that is applied around the side surfaces of the Peltier module and over the portion of the flex circuit that defines the window in which the module is seated, holds the Peltier module in the window. FIG. 6 also illustrates how the leads 156 integral with the Peltier module are soldered to the conductors 164.

The Peltier modules 150 have a front to back thickness that is approximately 2 to 4 mm greater than thickness in the same dimension as the flex strip 162. The Peltier modules 150 are mounted to the flex strip so the heat discharging surfaces 158 are located forward of the front facing surface of the flex strip 162 and the heat absorbing surfaces are located rearward of the back facing surface.

Two temperature sensors are mounted to the flex strip 162. A first temperature sensor 148 is mounted to the flex strip 162 to be able to monitor the temperature of the heat absorbing surface 152 of one of the Peltier modules 150. In FIG. 5 the temperature sensor 148 is shown as being physically disposed over the heat absorbing surface 152 of the Peltier module with which the sensor is associated. A second temperature sensor, sensor 168, is also mounted to the flex strip so as to extend rearward from the flex strip 162. Temperature sensor 168 is shown mounted to the flex strip 162 so as to be spaced away from the Peltier modules 150.

Figure 8:
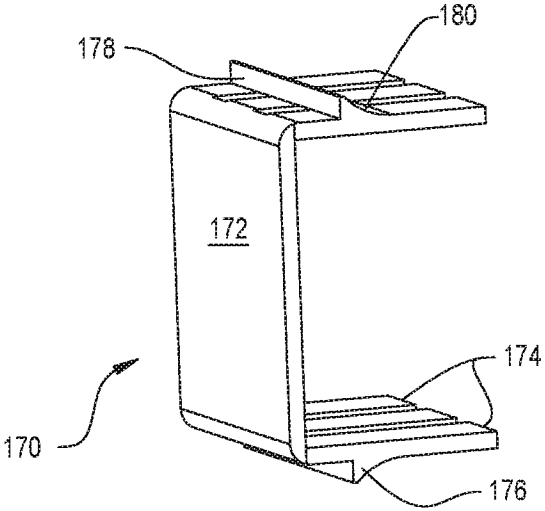
FIG. 8 is a second perspective view of a heat sink.
Figure 7:
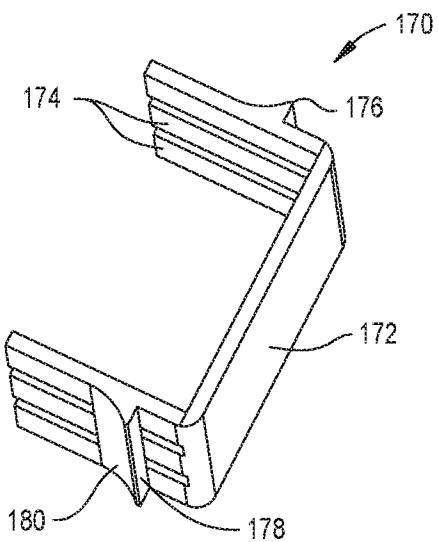
FIG. 7 is a perspective view of a heat sink.

Heat sinks 170, two identified, are attached to Peltier modules 150. A heat sink 170, seen best in FIGS. 7 and 8, is formed from a metal with good thermal conductive properties, for example material having a thermal resistance no greater than 20 C/W and, more preferably, no greater than 18° C./W. Each heat sink 170 includes a planar base 172. The components forming the cooling strip are typically dimensioned so that the heat sink base 172 has a surface area that is typically at minimum at least equal to the surface area of the heat discharging surface of the associated Peltier module 150. Fins 174 project perpendicularly forward from the opposed sides of the base 172. In the depicted version of the invention, three fins 174 extend forward from each side of the base. Fins 174 have a side-to-side thickness that allows the fins to seat in the slots 102 internal to the headband.

Ribs 176 extend outwardly from the outer surfaces of fins 174. In the depicted version of the invention, each rib 176 extends across the three fins 174 that extend from each side of the of the heat sink base 172. The ribs are located forward of the base. Each rib 176 has a rearwardly facing surface 178. Rearward facing surface 178 extends perpendicularly outwardly from the fins with which the rib is associated. A front facing surface 180 extends forward from the rearward facing surface 178. The front facing surface has a concave profile. As surface 180 extends forward, the surface curves inwardly. The front facing surface 180 merges into the planar outer side surface of the fins 174 with which the rib 176 is integral.

An adhesive able to maintain a bond when exposed to temperatures of between 5 and 50° C. and that is thermally conductive is used to hold the base of each heat sink 172 to the heat discharging surface 158 of the associated Peltier module. Here, thermally conductive is understood to mean having a thermal conductivity greater than 1 W/m-K. One such adhesive that can be employed as this adhesive is a metallic silver epoxy. One such epoxy is the MX-3 epoxy sold by the Arctic Silver Company of Switzerland.

Figure 9:
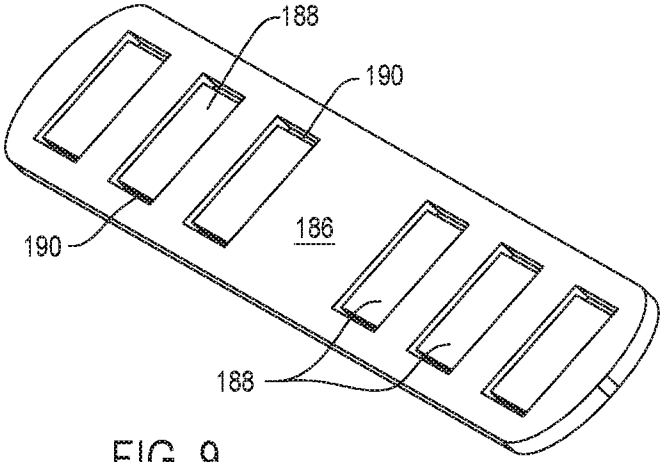
FIG. 9 is a perspective view of the inner foam layer of the cooling strip.
Figure 10:
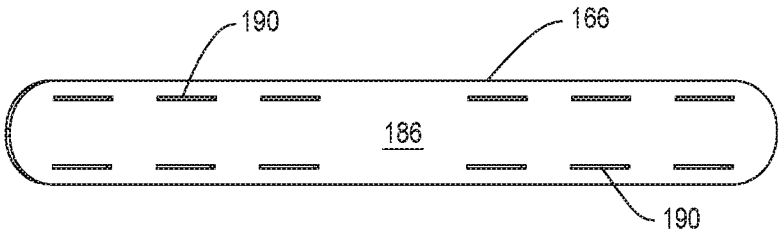
FIG. 10 is a plan view of the back side of the inner foam layer of the cooling strip.

An inner flexible foam layer 186 is disposed over the front facing surface of flex strip 162 and the front facing surfaces of the bases 172 of the heat sinks 170. Foam layer 186 is a foam such as a visco-elastic foam. Foam layer 186 has a perimeter that is identical to the perimeter of flex strip 162. Foam layer 186, described in detail with respect to FIGS. 9 and 10, is formed with plural spaced apart recesses 188, two recesses identified. The recesses 188 extend inwardly from the rearwardly directed surface of the layer. Each recess 188 is shaped to receive the base 172 of a separate one of the heat sinks 170. Foam layer 186 is also formed to have a number of through slots 190. Each through slot 190 extends from the portions of the foam layer that forms the base of a recess 188 and extends through the foam layer. Two slots 190 extend forward from each recess 188. The slots 190 forming each pair of slots extend inwardly from the opposed sides of the recess 188 with which the slots are associated.

Upon assembly of the cooling strip 120, the inner foam layer 186 is seated against the forward facing surface of the flex strip 162 so that portions of the Peltier modules that extend forward from the flex strip and the heat sink bases seat in the recesses 188. The heat sink fins 174 extend forward through the slots 190.

An outer foam layer, layer 134, is disposed over the front facing surface of flex strip 140. The outer foam layer 134, which is flexible, is formed from a material such as visco-elastic foam or spacer knit fabric. Foam layer 134 is shaped to have an outer perimeter that is substantially identical to the outer perimeter of the flex strip 162. Foam layer 134 is formed to have a number of spaced apart windows 136, two windows identified. Windows 136 extend front to back through the layer 136. Foam layer 134 is formed so that when the cooling strip is assembled, the section of each Peltier module that extends rearward from the flex strip seats in a separate one of the windows 136.

Outer foam layer 134 is further formed to have a through opening 138. The opening 138 is located between two of the windows 136. More particularly, the cooling strip 120 is constructed so that temperature sensor 168 seats in foam layer opening 134.

The components forming the cooling strip 120 are further selected so that the rearward directed surface of the outer foam layer is either flush with or extends rearwardly outwardly from the heat absorbing surfaces 152 of the Peltier modules 150 and the heat sensitive surface of temperature sensor 168.

Cooling strip 120 of this invention also includes a draw strip 128. Draw strip 128 is secured to and extends over the exposed rearwardly directed face of outer foam layer 134. Draw strip 128 is also disposed over and bonded to the exposed heat absorbing surfaces 152 of the Peltier modules 150 and temperature sensor 168. Draw strip 152 it should thus be appreciated extends outwardly beyond the heat absorbing surfaces 152 of the Peltier modules 150. The draw strip 128 is formed from flexible strip of material that has thickness typically no greater than 1 mm. The material forming the draw strip is also material that highly thermally conductive. Typically the thermal conductivity of the draw strip is greater than the thermal conductivity of the headband. In many versions of the invention, the draw strip has thermal conductivity of at least 100 W/mK, typically at least 400 W/mK and, more preferably, at least 700 W/mK. In some versions of the invention the draw strip 128 is formed from a laminate that has copper substrate and polyester superstrate. One such example is the PH3 heat spreader available from T-Global Technology Co., Taoyuan City, Taiwan. Other laminates with high thermal conductivity are formed from PGS graphite.

An adhesive, not illustrated, holds the draw strip 128 to the heat absorbing surfaces 152 of the Peltier modules, and the adjacent rearwardly directed surface of the outer foam layer 134. The adhesive is formed from material that has a thermal conductivity of at least 1.2 W/mK. The adhesive also holds the draw strip to temperature sensor 168.

Figure 11:
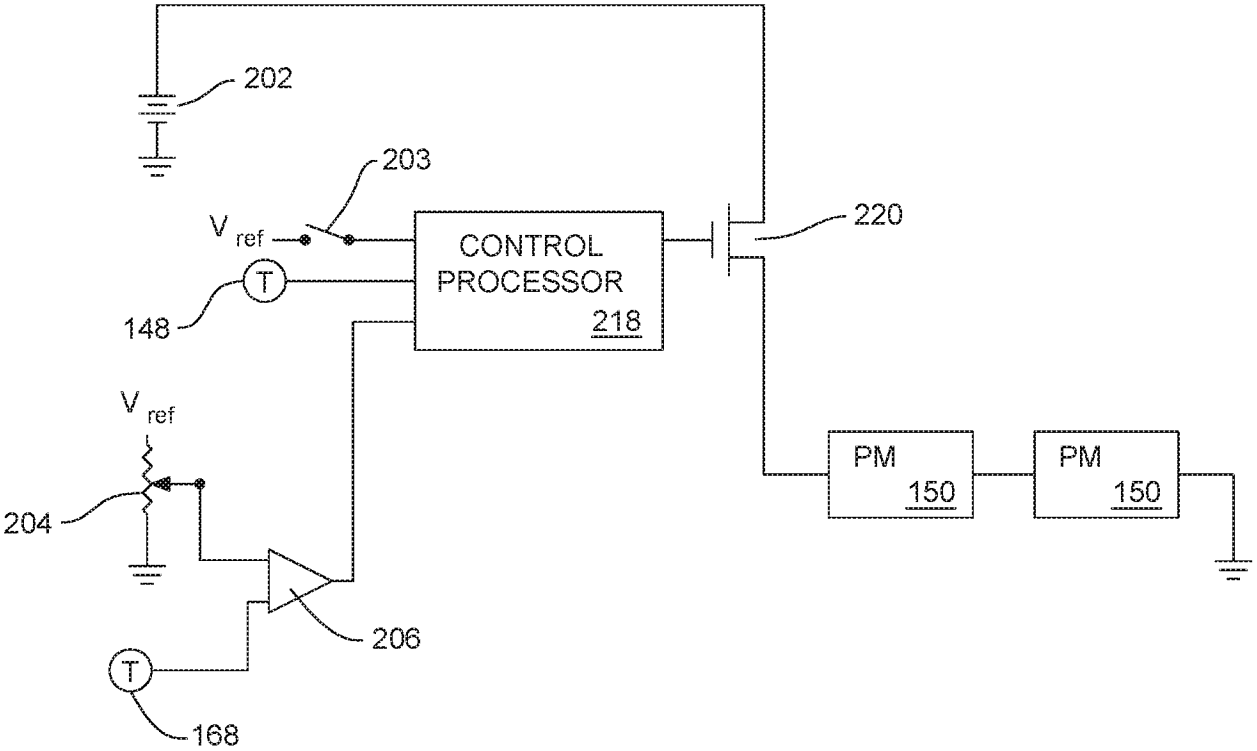
FIG. 11 is a block diagram of the circuit used to source current to the Peltier modules.

FIG. 11 is a schematic and partial block diagram drawing of the components that regulate the application of current to the Peltier modules 150. These components include a control processor 218. One input into the control processor 218 is the signal from an on/off switch 203. The signals from temperature sensors 148 and 168 are also used to control the regulation of the application of current to the Peltier modules 150. The signal from temperature sensor 148 is applied directly to the processor 218. In practice, it is understood that the control processor 218 uses a digitized representation of the signal from sensor 148 as the input for regulating operation of the Peltier modules 150. Many control processors include internal analog-to-digital converters that perform the necessary signal conversion.

The signal from temperature sensor 168 is shown as being applied to one input of a comparator 206. The second input into comparator 206 is the signal present at a wiper of a potentiometer 204. A reference voltage $V_{REF}$ is shown applied to one end of the potentiometer 204. The opposed end of the potentiometer 204 is shown tied to ground. The output from the comparator 206 is an input signal applied to the control processor 218.

Reference voltage $V_{REF}$ is also shown as being the signal applied to the control processor 218 when switch 203 is closed. Not shown and not part of the invention are voltage source that provides the $V_{REF}$ signal.

Control processor 218 functions by selectively connecting a battery 202 to the Peltier elements. In FIG. 11 an n-channel FET 220 is shown having its drain connected to the positive terminal of the battery 202 and its source connected to the series connected Peltier modules 150. Control processor 218 selectively asserts the gate signals that turns on and turns off the FET 220.

In many constructions of system 30, battery 202 and control processor 218 are typically not dedicated components associated with the cooling strip 120. In many versions of the invention, battery 202 also supplies the charge used to activate the fan internal to the fan module 54. The control processor 218 based on control switch not illustrated and not part of the invention regulates the application of energization signals to the fan. In many versions of the invention, the control processor is mounted in the module that contains the cells forming battery 202. Not part of this invention is how this module is connected to either the fan module 54 or the cooling strip 120.

When an individual wants to use the personal protection system with cooling strip of this invention, one step required is to mount the cooling strip 120 to the helmet 50. This step is performed by forcing the heat sink fins 174 through the slots 102 in the helmet headband 52. One result of this positioning of the heat sinks is the ribs 176 snap through the slots 102. Ribs 176 protrude outwardly from the headband 52 so the step like rearward facing surfaces 178 of the heat sinks presses against the adjacent front facing surface of the headband 52. The heat sink ribs 176 thus releasably hold the cooling strip 120 to the helmet 52.

As a consequence of the dimensioning of the components forming personal protection system 30, the sections of the inner foam layer 186 between the bases 172 of the heat sinks and the headband 52 are compressed.

The individual wearing the personal protection system places the helmet 50 on his/her head. As a result of the adjustment of the headband 52 the draw strip 128 presses against the forehead of the individual.

The battery and control module are then connected to the fan module 54 and cooling strip 120. The garment 32 is placed over the helmet. As part of this step of preparing the system for use, the garment is secured to the helmet so the face shield 38 is located forward of the helmet. Typically after these last steps are performed, the system 30 of this invention for use.

The individual often starts to activate the system by setting the appropriate control member so as to activate the fan.

Figure 12A:
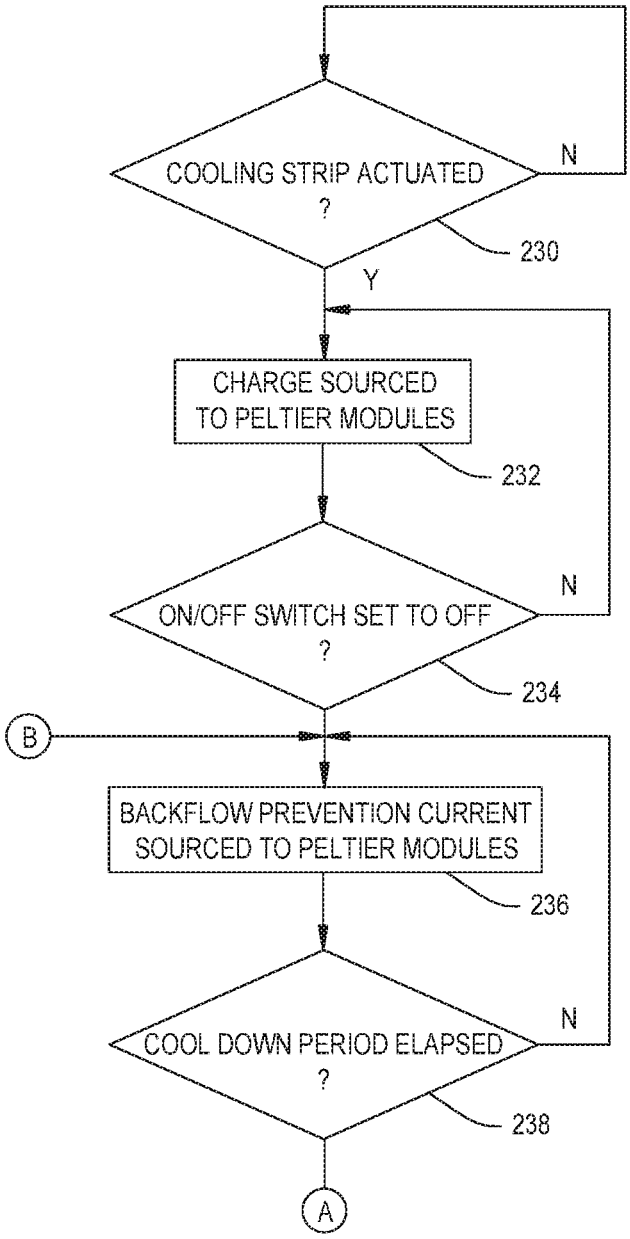
FIGS. 12A and 12B collectively form a flow chart of the steps that occur when the cooling strip of the personal protection system of this invention is actuated.
Figure 12B:
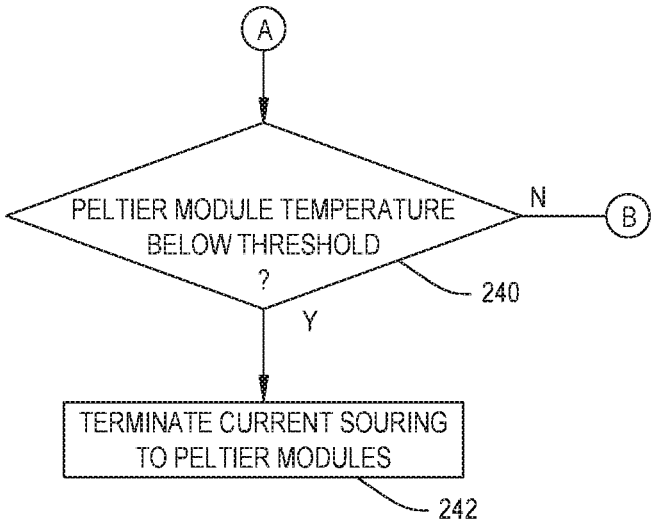

When the individual wants to use the cooling strip to remove heat generated by his or head, the individual closes switch 203, step 230 in FIG. 12A. The individual also sets the potentiometer 204 to indicate the extent to which the individual wants the heat drawn away from his/her body.

In response to the closing of switch 203, step 232 in FIG. 12A, control processor 218 selectively connects the battery 202 to the Peltier modules 150, step 232. In some versions of the invention, selectively gates FET 220 to apply a pulse width modified signal to the Peltier modules 150. The current applied during this actuation of the Peltier modules can be considered the cooling state current.

When the cooling strip is actuated, comparator 206 outputs a signal that represents the difference between the measured skin temperature of the individual wearing the personal protection system 30 as measured by sensor 168 and the skin temperature desired by the user based on the setting of the potentiometer 204. The control processor 218 adjusts the on duty cycle so that it is proportional to the difference between the measured skin temperature and the individual desired skin temperature. Thus, in some versions of the invention, the time period of a single pulse of the cooling state current is between 3 and 20 seconds. More topically, the pulse time is between 5 and 15 seconds. The minimum on duty cycle for which the current is sourced during is typically at least 25% of the total time period. The maximum on duty cycle is typically 75% of the total time period.

As a result of the current being flowed through the Peltier modules 150, the charge carriers transfer the thermal energy present on the heat absorbing surfaces 152 of the Peltier modules 150 towards the heat discharging surfaces 158. The heat absorbing surfaces 152 draws heat away from what is in contact with these surfaces. In the present invention, draw strip 128 is what is in contact with the heat absorbing surfaces 158. Thermal energy, contained in the draw strip 128 and, by extension the skin against which the draw strip is pressed, is drawn through the strip to the heat absorbing surfaces 152. The heat is transferred to the heat discharging surfaces 158 of the modules 150. Owing to the thermally conductive properties of the heat sinks 170, thermal energy reaching the heat discharging surfaces is conducted away from these surfaces 158 to the fins 174. The heat is transferred by conduction to the air immediately surrounding the fins 174. The warmed air parcels adjacent the fins 174 move away from the fins to be replaced by parcels that have yet to be heated. The forced movement of these air parcels as a result of the fan drawing new air into the garment 32 facilitates this convective transfer of thermal energy away from the fins 174. In this manner the heat extracted from the skin by the cooling strip of this invention does not build up in the air mass inside the garment immediately adjacent the person wearing the system.

At some point in the process of the procedure, the individual wearing system 30 turns off the cooling strip. The individual performs this action by opening switch 203. The loop back from step 234 to step 232 represents that, as long as switch 203 remains closed, the processor continues to provide current to the Peltier modules 150.

When switch 203 is opened, control processor 218 does not immediately negate the application of current to the Peltier modules 150. Instead, in a step 236 applies a backflow prevention current to the Peltier modules. This backflow prevention current is a current causes at least some heat transfer to occur from the heat absorbing surfaces 152 to the heat discharging surfaces 158 of the modules 150. Here "at least some heat transfer" is understood be heat transfer sufficient to substantially, if not totally, prevent heat transfer from the heat discharging surfaces 158 to the heat absorbing surfaces 152. The backflow prevention current is also typically at a level that does not result in the significant sinking of heat from the draw strip 128 to the heat absorbing surfaces 152. In versions of the invention wherein the processor only controls the current flow to the Peltier modules 150 by regulating the on duty cycle of the current flow, the on duty cycle when the backflow prevention current is applied is typically no greater than on duty cycle when the cooling strip is set to provide the minimal amount of noticeable cooling. Thus, the backflow prevention current is a current that is equal to or less than the cooling state current.

As represented by the loop from step 238 back to step 236, the backflow prevention current is typically applied for a select period of time, a cool down period. This time period is often between 2 and 10 minutes. After this time period elapses, the processor 218, in step 240 based on the signal from sensor 148, determines whether or not the temperature on the heat absorbing surface 152 of the module to which the sensor is attached is below a threshold temperature. If this evaluation tests positive, then it is unlikely that the final turning off of the cooling strip will result in the backflow of heat to the module heat absorbing surfaces that will be noticeable to the individual. Accordingly, if the evaluation of step 240 tests positive, in step 242 the processor totally deactivates the cooling strip. Thus, in step 242 the processor turns FET 220 off so as to completely terminate the sourcing of current to the Peltier modules.

Alternatively, the evaluation of step 240 may test negative. This indicates that residual thermal energy stored in the heat sinks could backflow to the module heat absorbing surfaces 152 so as to heat these surfaces 152 to above an unacceptable temperature. Therefore, if the evaluation of step 240 tests negative, as indicated by the loop back to step 238 continues to apply a backflow prevention current to the modules. Steps 240 and 242 are reexecuted until the evaluation of step 242 indicates the sensed heat absorbing surface temperature is at a below the selected maximum level.

System 30 is designed so that the cooling strip 120 can be removably attached to the helmet 50 to which the strip is mounted. This means that if an individual does not want to use the cooling strip 120 he/she does not have to wear a helmet that is weighted down with for this individual is a useless component. If the individual wants to use the cooling strip, the strip is easily installed by the snap fitting of the heat sinks to the head band 52. In the event a cooling strip malfunctions, the fact that the strip is releasably attached to the helmet makes it easy to replace with a properly functioning strip.

The system is thus further designed so the heat sinks perform two functions. The heat sinks 170 draw the heat away from the Peltier modules 150. The heat sinks also function as the components that releasably hold the cooling strip 120 to the rest of the system.

System 30 of this invention is designed so inner foam layer 186 places a biasing force on the components of the cooling strip located rearward of the layer 186 Specifically, the outer foam layer 186 urges the Peltier modules 150 and the inner foam layer 134 towards the skin of the individual wearing the system 30. Inner foam layer 134 places a force on the sections of draw strip 128 between the modules 150 rearwardly, again, towards the individual wearing the system 30. These forces press substantially all, if not the whole of, the rear facing surface of the draw strip 128 against the skin. The draw strip 128 owing to the flexibility of the material forming the strip is compliant against the skin. This strip-against-skin abutment occurs even though the cooling strip 120 presses against a portion of the patient's anatomy that is not linear in shape. This means that when the cooling strip 120 is actuated, heat is drawn away from surface of the skin that is contact with the draw strip 128. This surface area of the portion of the draw strip that presses against the skin is at least two times and more often at least four times greater than the surface area of the skin covered by the Peltier modules. This means that, when drawing a given amount of heat away from the skin, the amount of heat per unit area over which the heat is drawn away according to this invention is less than if the heat were only drawn away from the area underneath the Peltier modules. This minimizes the extent to which an individual using this system in order to feel cool under a head enclosing garment is exposed to the disconcerting sensation of having heat draw from a few small sections of his/her skin.

System 30 of this invention is further constructed so that when the cooling strip 120 is actuated, the Peltier modules 150 are cycled on and off. The off phases occur during the off duty cycles of the pulse width modulated periods. One benefit of so cycling the activation of the Peltier modules 150 is that, providing this off time, the system allows the thermal energy already accumulated on the heat sink fins 174 to dissipate away from the heat sink 170. This reduces the undesirably build up of heat in the air immediately surrounding the heat sink. Further by cycling the Peltier modules 150 off, the draw on the battery 202 is reduced.

Moreover, if the heat is continually drawn away from the skin, an individual may become acclimated to this heat draw. Should an individual become so acclimated, he/she feels may feel it necessary to, in order to feel cool, increase the heat draw away from his/her skin. If an individual feels the need to increase the heat draw, he/she must increase the current flow through the Peltier modules 150. One undesirable effect of this action is that it can result in the more rapid discharge of the batteries. Since the batteries are typically the same batteries used to power the fan, this can increase the likelihood that the batteries could completely discharge. If the batteries are so discharged it may be necessary to interrupt the procedure to provide a freshly battery. Having to so interrupt the procedure can increase the overall time it takes to perform the procedure.

Thus a further benefit of this system being configured to cyclically turn off the Peltier modules 150 when the cooling strip 120 is actuated is that the modules 150 are not continually in the state in which they draw large quantities of heat away from the individual wearing the system. This reduces the extent to which an individual, over a period of time, acclimates to the heat draw. This results in like reduction in the extent to which an individual, feeling so acclimated, feels that it is necessary to increase the current flow to the Peltier modules in order to obtain their benefit. This reduces the likelihood that the individual, in order to feel cool, will want to set the current draw to such a high level that the battery 202 completely discharges.

System 30 of this invention is further designed so that, upon the turning off of the cooling strip, a backflow prevention current is applied to the Peltier modules 150 for a period of time. This substantially reduces the likelihood that when the cooling strip 120 is turned off, heat stored in the heat sinks 170 backflow to the heat absorbing surfaces and the draw strip. Preventing this heat flow essentially eliminates the likelihood that upon the turning off of the cooling strip the individual wearing the system will immediately find his/her head being heated.

A further feature of this invention is that the flex strip 162 internal to the cooling strip performs two functions. The strip functions as the membrane that supports the conductors that extend to the Peltier modules and the temperature sensors. The flex strip 162 also functions as the support frame to which the outer structural components of the cooling strip are mounted.

The above is directed to one specific version of the invention. Other versions of the invention may have features different from what has been described.

For example, not all versions of the invention may have each of the above-described features. For example not all versions of the invention may include each of; the cooling strip; the control system for pulse controlling the Peltier modules; the control system for, after turning off the Peltier modules flowing a backflow prevention current through the modules.

In some versions of the invention, it may not be necessary to provide the helmet with a fan. Similarly the cooling strip could be part of a personal protection system that simply consists of a headband to which a face shield is attached.

Similarly, the structural features of the invention may be different from what has been described. In some versions of the invention the inner foam layer may only be spaced apart foam sections that are located forward of the heat discharging surfaces of the Peltier modules. The outer foam layer may be spaced apart sections of foam disposed between the Peltier modules. In some versions of the invention, one or both of the foam layers or similar biasing components may not be necessary.

There is no requirement that in all versions of the invention one more foam layers function as the biasing members that urge the draw strip toward the skin of the individual against whim the cooling strip is applied. For example, mechanical springs may take the place of one or both of the foam layers. One such type of mechanical spring that can perform this function is a wave washer. Alternatively a compressible yet resilient rubber such as a silicone rubber may function as the biasing component. If the compressible resilient material is also highly thermally conductive, this material may be disposed over the heat absorbing surfaces 152 of the Peltier modules 150. In these versions of the invention this resilient material functions both as the flexible draw strip of the cooling strip and the component that biases the draw strip against the skin of the individual wearing the personal protection system.

There is no requirement that, in all versions of the invention, the cooling strip 120 be releasably mounted to another component of the personal protection system so the draw strip presses against the forehead. In some versions of the invention, the cooling strip 120 may be mounted to another component of the system to press against the back of the head, the neck, the side of the head or another section of the individual's anatomy. Likewise, some personal protection systems of this invention may be designed so that plural cooling strips can be attached to the components of the system that hold the garment over the individual using the system. Thus, given the ability to remove the cooling strips from the other components, typically the helmet, this feature of the invention allows further customization of the system for each individual. For example, for an individual that likes to feel very cool during a procedure, two cooling strips can be attached to the helmet. One strip is positioned to press against the forehead, the second is positioned against the back of the head. The system would have a separate configuration for an individual that only wants the back of his/her cooled. For this individual, only the single back located cooling strip is attached. Thus this individual receives the benefit of the cooling he/she desires without having to wear a version of the system that is weighted down by an unused cooling strip.

From the above it should also be clear that, in some versions of the invention, an assembly other than a helmet may function as the structural member that supports garment. One such assembly is a brace like unit that is worn around the shoulders of the individual taking advantage of the system.

In some versions of the invention, the cooling strip is mounted to the complementary component so that the heat sink fins are in the duct or nozzle or immediately downstream of the nozzle opening through which the air from the fan module is discharged. A benefit of this version of the invention is that the air flow over the heat sinks fins improves the convective transfer of heat away from the heat sinks over the transfer that occurs when the fins are in static air.

The arrangement of the components forming the draw strip may also vary from what has been described. For example, in some versions of the invention, the Peltier modules 150 may be mounted to the flex strip 162 so the heat absorbing surfaces of the modules are disposed against the inner face of the strip. In these versions of the invention the flex strip is formed from material that has a relatively high thermal conductivity. One such material is copper. In these versions of the invention the flex strip is therefore not formed with windows. In some embodiments of these versions of the invention the draw strip is secured over the outer face of the flex strip. It should be understood that in these embodiments of the invention, the draw strip has a thermal conductivity that is greater than the thermal conductivity of the flex strip. In alternative embodiments of this version of the invention, a separate draw strip is not affixed to the flex strip. This, in these embodiments of the invention, the flex strip, in additional to performing its other functions serves as the draw strip of the cooling strip.

Likewise, the circuit used to control the sourcing of current to the Peltier modules may also vary from what has been described. That may not be a need in all versions of the invention to use pulse width modulation to regulate the rate at which the Peltier modules transfer heat away from the skin. In some versions of the invention, this regulation may be performed by using an adjustable current source to set the level of the current that is sourced through the Peltier modules 150. In some versions of the invention the shift from applying the cooling state current to the backflow prevention current is performed by adjusting both the on duty cycle and level of current applied to the Peltier modules. In some versions of the invention, for the application of one or both of the cooling state current and the backflow prevention current is regulated by, during a single on-cycle, sequentially applying current at plural levels to the Peltier modules.

This invention is not limited to assemblies wherein the draw strip of the cooling strip is simply a sheet of material or a flexible laminate structure. In some constructions of the invention, the draw strip may consist of a pack filled with phase change material. Phase change material is material that, at the appropriate high temperature, here approximately 25° C., absorbs heat and turns from solid to liquid. Then at a lower temperature, here approximately 15° C. or less, releases the stored heat and returns to the solid state. Within the pack the phase change material circulates from the position adjacent where the outside environment is at a high temperature, the skin of the individual, to where the outside environment is at a lower temperature, adjacent the heat absorbing surfaces of the Peltier modules 150. The phase change material thus transfers the heat away from the sections of the skin between the Peltier modules 150 to the Peltier modules.

In some versions of the invention, current flow through the Peltier modules may be controlled by both pulse width modulation and by regulating the level of the current flow. Thus, during the time in which the cooling strip is actuated, the current at first high level is sourced to the modules 150. Pulse width modulation is used to regulate the sourcing of this current so as to regulate the rate at which the modules draw heat away from the skin. Once the cooling strip 120 is deactivated, a low level current is continually applied to the modules. This low level current is the backflow prevention current applied to the modules 120 to prevent the undesirable backflow of thermal energy to the heat absorbing surfaces 152 of the modules.

In versions of the invention where the heat sinks also function as components that removably hold the cooling strip to the support structure, the heat sinks may not always snap into openings in the support structure. For example the heat sinks may be flexible clips. The clip portions of the heat sinks fit over complementary beam link sections of the support structure.

In some versions of the invention some or all of the actuatable control members used to turn on/turn off/set the cooling strip 120 as well as the circuit that regulates the sourcing of the current to the Peltier modules are built into the cooling strip. Often one or more of these components are mounted to the flex strip. A benefit of this construction of this invention is that it avoids the expense of adding these components to each personal protection system to which the cooling strip may or may not be attached.

In some versions of the invention a temperature sensor may be mounted to one or more of the heat sinks 170. The signal from this temperature sensor is used to determine whether or not it is still necessary to provide the backflow prevention current. More specifically, if this temperature sensor indicates that the temperature of the heat sink is at or rises above a threshold temperature than the processor 218 will continue to cause the backflow prevention current to be sourced to the Peltier modules 150.

The means by which the current is applied to the Peltier modules may also vary from what has been described. Thus, there is no requirement that in all versions of the invention, a pulse width modulation system is employed to regulate the actuation of the Peltier modules. In some versions of the invention, the current may be an always on current that is regulated by regulating the voltage of the actuation signal.

In some versions of the invention, the structural members of the helmet or other article to which the cooling strip is mounted may be made from thermally conductive material. The heat sunk to the heat sinks is drawn into these components. It should be recalled that these components are spaced away from the person wearing the personal protection unit. Thus, these components do not function as thermal conductors that simply return heat to the person from which the heat was extracted. These components function as heat sinks with added surface area over which the heat drawn away from the person wearing the personal protection system of this invention is dispersed into the environment.

Accordingly, it is an object of the appended claims to cover all such modifications and variations that come within the true spirit and scope of this invention.

What is claimed is:

1. A personal protection system, said system comprising:

a headband adapted to be worn around the head of an individual;

an assembly mounted to the headband for holding a face shield in front of the face of the individual; and a cooling strip mounted to the headband, said cooling strip comprising:

at least one thermoelectric cooling module with a heat absorbing surface and a heat discharging surface;

a flexible draw strip formed from thermally conductive material that is attached to and extends outwardly from the heat absorbing surface of the at least one thermoelectric cooling module;

wherein the cooling strip is mounted to the headband so that the flexible draw strip has an exposed surface directed toward the head of the individual; and a biasing assembly that is disposed against said flexible draw strip for urging the exposed surface of said flexible draw strip against the head of the individual.

2. The personal protection system of claim 1, wherein:

said cooling strip comprises plural said thermoelectric cooling modules that are spaced apart from each other;

said flexible draw strip extends between the heat absorbing surfaces of said thermoelectric cooling modules; and said biasing assembly is positioned to urge the section of said flexible draw strip located between said thermoelectric cooling modules against the head of the individual.

3. The personal protection system of claim 1, wherein said biasing assembly comprises:

a first biasing component that urges said at least one thermoelectric cooling module and said flexible draw strip away from said headband and towards the head of the individual; and a second biasing component that urges said flexible draw strip away from said at least one thermoelectric cooling module.

4. The personal protection system of claim 1, wherein said biasing assembly comprises at least one foam element that urges said flexible draw strip against the head of the individual.

5. The personal protection system of claim 1, wherein said cooling strip comprises a heat sink that extends outwardly from the heat discharging surface of said at least one thermoelectric cooling module.

6. The personal protection system of claim 5, wherein said heat sink comprises a feature for releasably securing said heat sink to the headband without supplemental fasteners.

7. The personal protection system of claim 1, wherein the headband and said cooling strip are formed with complementary features (176, 190) for releasably securing said cooling strip to said headband without supplemental fasteners.

8. The personal protection system of claim 1, wherein said headband is part of a helmet and the assembly mounted to the headband for holding the face shield is configured to hold a garment over the helmet.

9. The personal protection system of claim 8, wherein a fan is mounted to the helmet for drawing air through the garment.

10. The personal protection system of claim 1, wherein the headband has a thermal conductivity and said flexible draw strip has a thermal conductivity, wherein the thermal conductivity of the flexible draw strip is greater than the thermal conductivity of the headband.

11. The personal protection system of claim 1, wherein said flexible draw strip has a thermal conductivity of at least 100 W/mK.

12. The personal protection system of claim 1, wherein said flexible draw strip has a thermal conductivity of at least 400 W/mK.

13. The personal protection system of claim 1, wherein said flexible draw strip and said biasing assembly of said cooling strip are formed from separate components.

* * * * *